US012201247B2

(12) United States Patent
Masters

(10) Patent No.: US 12,201,247 B2
(45) Date of Patent: Jan. 21, 2025

(54) TOILET ODOR VACUUM FILTRATION DEVICE

(71) Applicant: Donald Scott Masters, Belmont, NH (US)

(72) Inventor: Donald Scott Masters, Belmont, NH (US)

( * ) Notice: Subject to any disclaimer, the term of this patent is extended or adjusted under 35 U.S.C. 154(b) by 155 days.

(21) Appl. No.: 18/163,632

(22) Filed: Feb. 2, 2023

(65) Prior Publication Data

US 2024/0260796 A1 Aug. 8, 2024

(51) Int. Cl.
*A47K 13/30* (2006.01)

(52) U.S. Cl.
CPC ..... *A47K 13/307* (2013.01)

(58) Field of Classification Search
CPC ..... A47K 13/307
USPC ..... 4/213, 209
See application file for complete search history.

(56) References Cited

U.S. PATENT DOCUMENTS 3,005,993 A * 10/1961 Corliss ..... E03D 5/016 4/317
3,238,124 A * 3/1966 Burton ..... C02F 3/06 4/DIG. 9
4,174,371 A * 11/1979 Bell ..... C05F 3/04 422/111
4,434,938 A * 3/1984 Rosenkrantz ..... E03D 9/007 239/289
4,556,999 A * 12/1985 Lindley ..... A47K 13/307 4/209 R
4,726,078 A * 2/1988 Carballo ..... E03D 9/052 4/209 FF
5,231,705 A * 8/1993 Ragusa ..... E03D 9/05 4/348
5,355,536 A * 10/1994 Prisco ..... E03D 9/052 4/352
5,372,710 A * 12/1994 Frank ..... B64D 11/02 210/167.01
6,081,935 A * 7/2000 Kishi ..... E03D 7/00 4/300
6,085,364 A * 7/2000 Baierlein ..... B63B 29/14 4/300
6,772,449 B1 * 8/2004 Wolfe ..... E03D 9/05 4/213
6,804,837 B1 * 10/2004 Guess, Sr. ..... E03D 9/052 4/213
6,944,888 B1 * 9/2005 Canales, Jr. ..... E03D 9/052 4/213
7,117,548 B1 * 10/2006 Reyes ..... E03D 9/052 4/352
7,211,187 B2 * 5/2007 Lumbert ..... C02F 11/13 210/178

(Continued)

FOREIGN PATENT DOCUMENTS

JP 2000096668 A * 4/2000
WO WO-2004063480 A2 * 7/2004 ..... A47K 13/307
WO WO-2008038028 A2 * 4/2008 ..... E03D 9/052

*Primary Examiner* — Lori L Baker
(74) *Attorney, Agent, or Firm* — Dunlap Bennett & Ludwig, PLLC

(57) ABSTRACT

A toilet odor vacuum filtration device adapted to draw gases from along the rear portion of the toilet bowl and toilet seat by disposing an intake port between the toilet bowl and toilet seat. Inlets along the intake port urge gases and odor from the toilet bowl area, through a hose, and into an air pump and filtration assembly, wherein the odors are filtered from the captured gases prior to the captured gases being released to the external environment.

6 Claims, 3 Drawing Sheets

(56) References Cited

U.S. PATENT DOCUMENTS 7,380,292 B1 * 6/2008 Harris ..... A47K 13/10 4/213
11,634,899 B2 * 4/2023 Salazar ..... A47K 13/307 4/347
2001/0054195 A1 * 12/2001 Simpson ..... E03D 9/05 4/213
2006/0021120 A1 * 2/2006 Nickle ..... E03D 9/05 4/213
2006/0064805 A1 * 3/2006 Yamamoto ..... E03D 9/05 4/213
2006/0096017 A1 * 5/2006 Yamasaki ..... G01F 23/00 4/420
2007/0240250 A1 * 10/2007 Foerster ..... E03D 9/052 4/213
2007/0289053 A1 * 12/2007 Tolbert ..... E03D 9/052 4/213
2008/0222784 A1 * 9/2008 Ware ..... E03D 9/052 4/313
2008/0235856 A1 * 10/2008 Ineson ..... E03D 9/05 4/217
2009/0235442 A1 * 9/2009 Lee ..... E03D 9/052 4/217
2009/0307831 A1 * 12/2009 Shahar ..... E03D 9/052 29/401.1
2010/0058525 A1 * 3/2010 Aitchison ..... E03D 9/052 4/348
2012/0186007 A1 * 7/2012 Perez ..... E03D 9/052 4/213
2012/0233758 A1 * 9/2012 Tolles ..... E03F 1/006 4/321
2014/0304904 A1 * 10/2014 Claunch ..... E03D 5/016 4/318
2020/0123755 A1 * 4/2020 Payziev ..... E03D 9/04
2021/0140161 A1 * 5/2021 Salazar ..... E03D 9/052

* cited by examiner

TOILET ODOR VACUUM FILTRATION DEVICE

BACKGROUND OF THE INVENTION

The present invention relates to toilet odor removing methods, systems, and apparatuses, and more particularly, to a battery powered toilet odor vacuum filtration device.

Toilets are designed for disposing of solid and liquid waste, but such wastes' odors linger for possibly hours after the toilet's use if there is insufficient ventilation. Although these odors are natural, such odors can be unbearable and embarrassing. Accordingly, almost all users of toilets would appreciate the elimination or reduction of the odor during or immediately after use of the toilet. However, toilets widely available in the market in either commercial or residential settings do not provide an odor removing system.

Current solutions aim at masking the odor with other scents, like perfume. People, however, can have an allergic reaction to the perfume used to mask the odor. Moreover, adding chemicals to the air can be a physical irritant to some or be an irritant to their sensibilities in these times of rampant air pollution and climate change. Furthermore, perfume canisters need to be refilled and thus are useless during the times when the canister is empty.

A need exists for a toilet odor vacuum filtration device that vacuums and filters gases (air and odor) emanating from the toilet before discharging it into the bathroom.

SUMMARY OF THE INVENTION

In one aspect of the present invention, a device for removing odors from a toilet bowl, the device includes the following: an intake port dimensioned to be disposed between a rim of the toilet bowl and the toilet seat; and an air pump and filter assembly fluidly coupled to inlets of the intake port so that gases adjacent the toilet bowl are urged into the inlets, wherein the intake port provides a leading edge having a curvature that traces a curvature of said rim, wherein the inlets are along the leading edge, and wherein a body of the intake port provides holes for receiving connector of a toilet seat hinge the pivotably connects the toilet seat to the toilet bowl.

By 'traces', it is understood that the line defining the curvature of the leading edge is radially similar (approximately the same as) the curvature of the toilet bowl rim and/or the toilet seat so that the leading edge is spaced apart from those other edges/curvatures for substantially the entirety of its length.

In another aspect of the present invention, a system for removing odors emanating from a toilet bowl, the system providing the following: an intake port disposed between a rim of the toilet bowl and a toilet seat pivotably connected thereto, the intake port includes: one or more inlets disposed adjacent a rim of the toilet bowl; and a body having one or more mounting holes set back from the one or more inlets; an air pump and filter assembly fluidly coupled to the one or more inlets so that gases adjacent the toilet bowl are urged into the one or more inlets; and a toilet seat hinge pivotably coupling the toilet seat to the toilet bowl, wherein the toilet seat hinge has one or more mounting connectors, each mounting connector received by one of said mounting holes.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a toilet odor vacuum filtration device adapted to draw gases from along the rear portion of the toilet bowl and toilet seat by disposing an intake port between the toilet bowl and toilet seat. Inlets along the intake port urge gases and odor from the toilet bowl area, through a hose, and into an air pump and filtration assembly, wherein the odors are filtered from the captured gases prior to the captured gases being released to the external environment.

Figure 1:
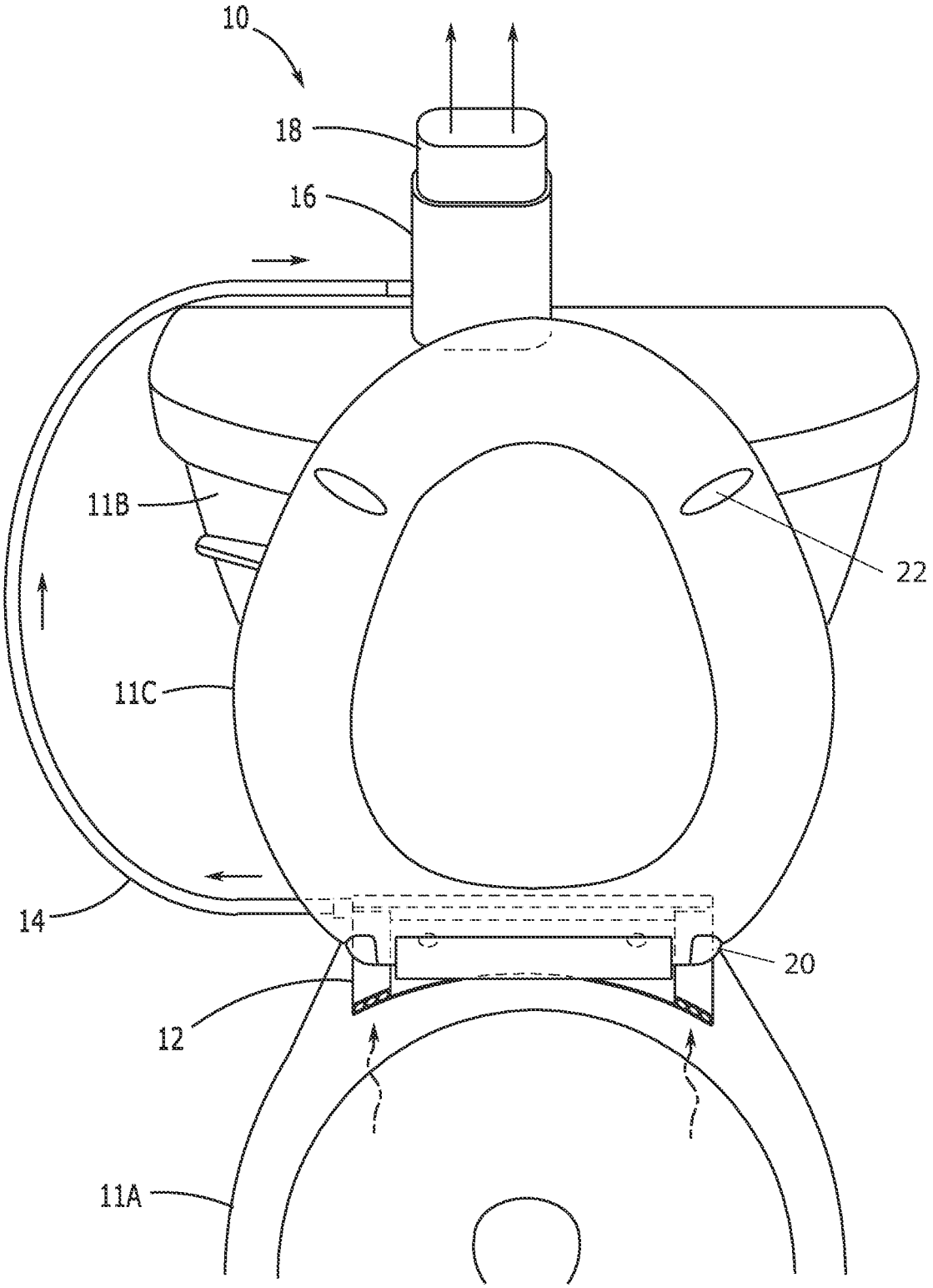
FIG. 1 is a front top perspective view of an exemplary embodiment of the present invention.
Figure 2:
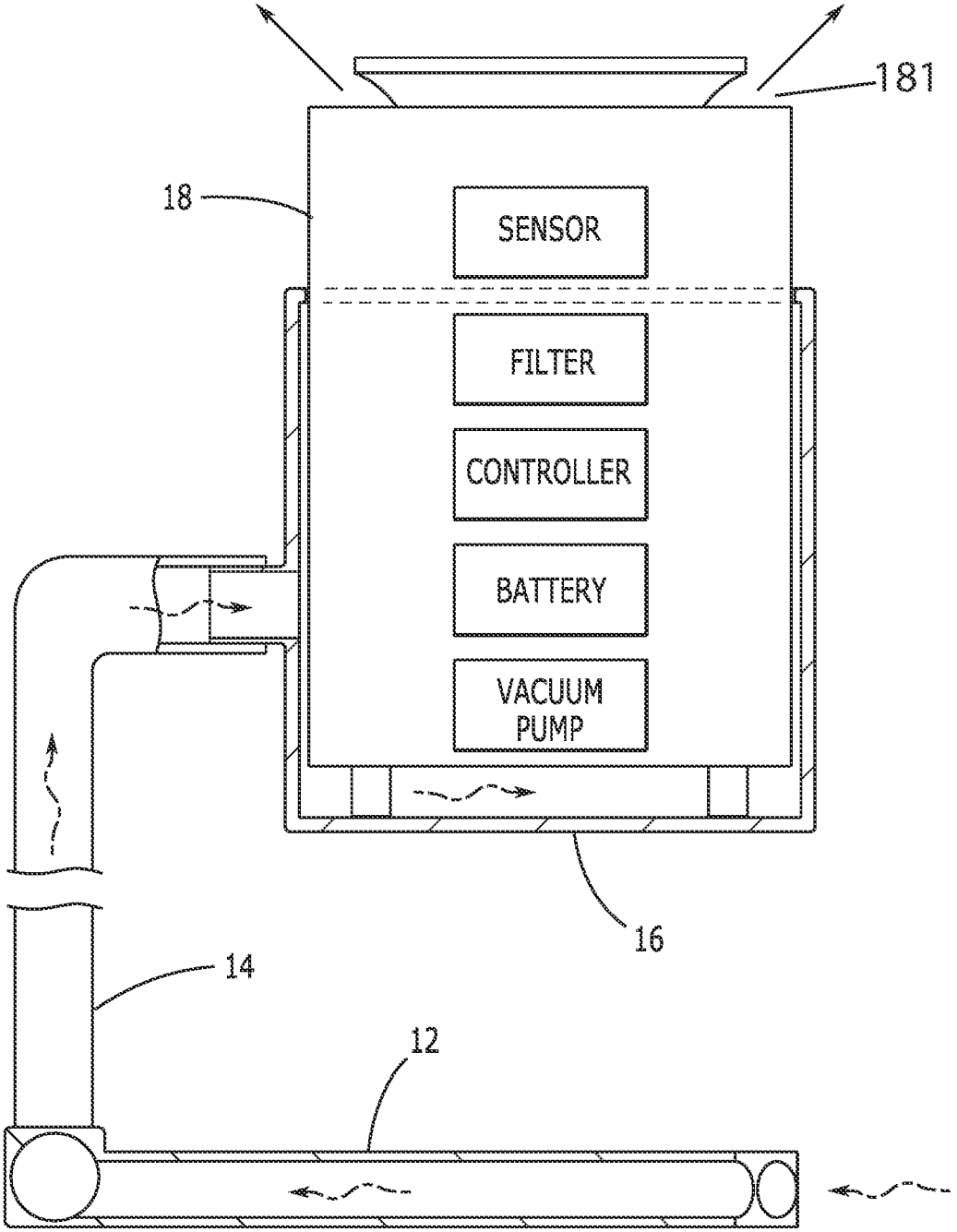
FIG. 2 is a schematic diagrammatical view of an exemplary embodiment of an air pump/vacuum/filtration assembly of the present invention, with parts broken away for clarity.
Figure 3:
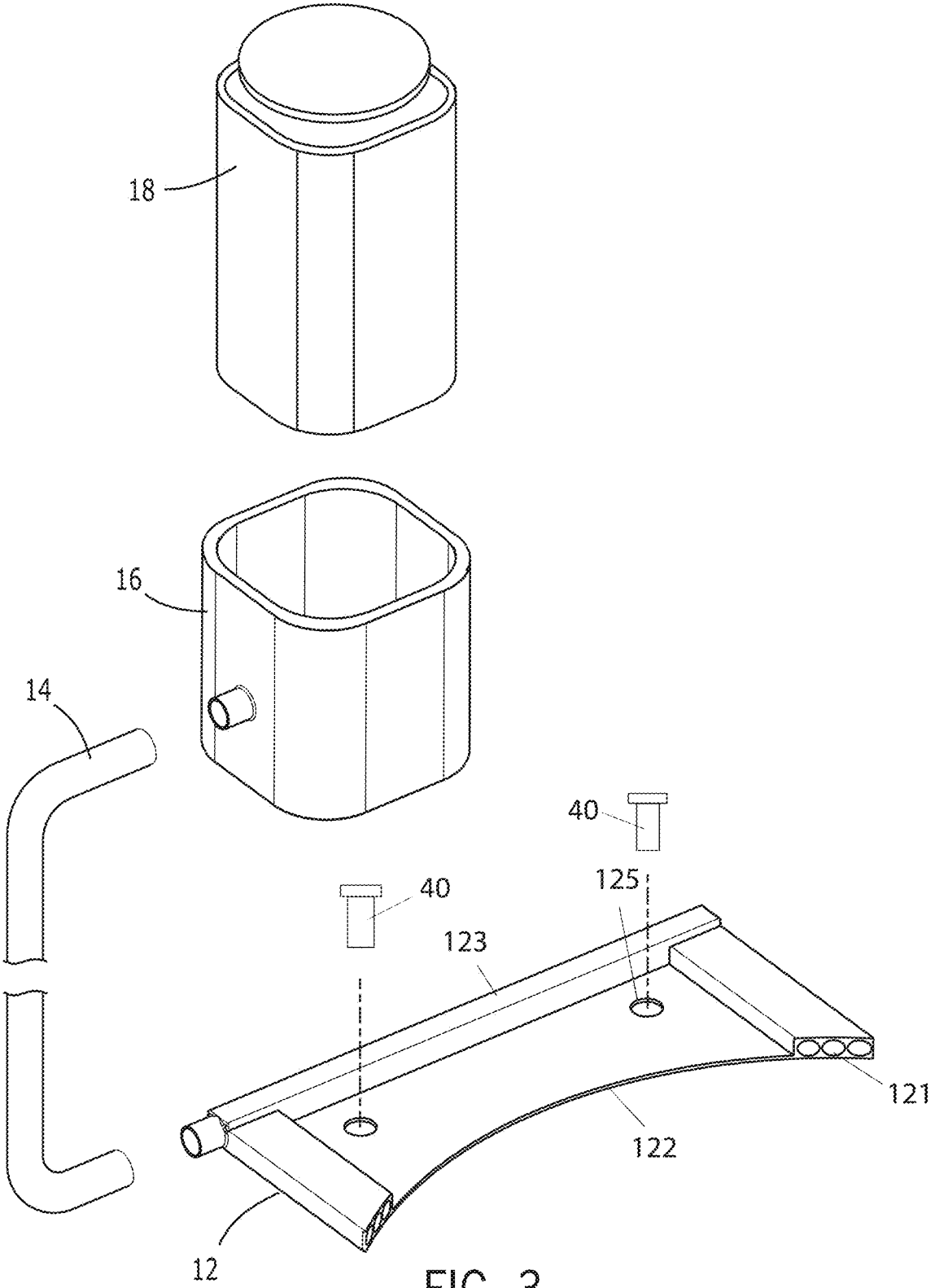
FIG. 3 is an exploded perspective view of an exemplary embodiment of the present invention.

Referring to FIGS. 1-3, the present invention may include a toilet odor vacuum filtration device 10. Typically, a toilet seat hinge 20 pivotably connects the toilet seat 11C to the toilet bowl 11A. Because of the toilet seat hinge 20, there is a gap between the rim of the toilet bowl 11A and the underside of the toilet seat 11C (which is why said underside has feet 22). This gap is approximately half an inch to one inch.

The present invention contemplates an intake port 12 dimensioned and adapted to occupy the gap between the toilet seat 11C to the toilet bowl 11A, along and/or adjacent the rear portions of the toilet seat/bowl. The intake port 12 provides one or more inlets 121 fluidly coupled to an air pump/filter assembly 18 so that air is urged into said one or more inlets 121.

The body 123 of the intake port 12 is low profile (having a sandwich height of approximately one inch or less). The body 123 may provide toilet seat hinge holes 125 for receiving the connectors 40 of the toilet seat hinge 20 that connect it to the toilet bowl 11A. The body 123 may provide a leading edge 22 that may have a curvature that conforms to the curvature of the toilet bowl and toilet seat 11C. The inlet(s) 121 may be along this leading edge 122 so that they communicate with the opening of the toilet bowl 11A, whereby air taken up through the inlet(s) 122 includes odors in the toilet bowl 11A, preventing their escape.

The inlet(s) 121 may be fluidly coupled to the air pump/filter assembly 18 by way of a hose 14. The air pump assembly 18 may be disposed in a retainer 16 located along the upper surface of the toilet tank/lid 11B.

Referring to FIG. 2, the air pump/filter assembly 18 may include a controller, filter, vacuum pump, sensor, and a battery for powering the pump, controller, and sensor. The filter may be any variety that removes and stores odors from the air. The sensor and controller may be electrically coupled so that the programmable controller can regulate the filtration and venting of the gases urged from the inlets 121 through the hose 14 and into the air pump/filter assembly 18. The controller and sensor can also regulate the fan speed and battery life. After being filtered by the filter in the air pump/filter assembly 18, the gases may be released from vents 181 along the exterior of the air pump/filter assembly 18. Because of this, the air pump/filter assembly 18 may be located five or more feet from the toilet.

A method of using the present invention may include the following. The toilet odor vacuum filtration device 10 disclosed above may be operatively associated with a toilet. A person would turn the vacuum pump on while using the toilet to remove odors from the toilet bowl 11A.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. A device for removing odors emanating from a toilet bowl, the device comprising:

an intake port comprising:

a first plurality of inlets along a first lateral edge of the intake port;

a second plurality of inlets along a second lateral edge of the intake port;

an elongated body longitudinally extending along a trailing edge of the intake port;

a planar portion separating and interconnecting the first and second pluralities of inlets, wherein the planar portion directly connects to the body and the first and second pluralities of inlets, wherein the planar portion provides a curved leading edge, and wherein the planar portion has a uniform sandwich height that is less than half a sandwich height of the body and the first and second pluralities of inlets, respectively; and one or more mounting holes disposed in the planar portion, each mounting hole dimensioned for receiving a connector of a toilet seat hinge; and an air pump and filter assembly fluidly coupled to inlets of the intake port so that gases adjacent the toilet bowl are urged into the inlets.

2. The device of claim 1, wherein the curved leading edge traces a curvature of said rim.

3. The device of claim 2, wherein the pluralities of inlets are along the leading edge.

4. A system for removing odors emanating from a toilet bowl, the system comprising:

an intake port comprising:

a first plurality of inlets along a first lateral edge of the intake port;

a second plurality of inlets along a second lateral edge of the intake port;

an elongated body longitudinally extending along a trailing edge of the intake port;

a planar portion separating and interconnecting the first and second pluralities of inlets, wherein the planar portion directly connects to the body and the first and second pluralities of inlets, wherein the planar portion provides a curved leading edge, and wherein the planar portion has a uniform sandwich height that is less than half a sandwich height of the body and the first and second pluralities of inlets, respectively; and one or more mounting holes disposed in the planar portion;

an air pump and filter assembly fluidly coupled to the one or more inlets so that gases adjacent the toilet bowl are urged into the one or more inlets; and a toilet seat hinge pivotably coupling the toilet seat to the toilet bowl, wherein the toilet seat hinge has one or more mounting connectors, each mounting connector received by one of said mounting holes.

5. The system of claim 4, wherein the curved leading edge traces a curvature of said rim.

6. The system of claim 5, wherein the pluralities of inlets are along the leading edge.

* * * * *